US005410970A

United States Patent [19]

Stephenson, Jr.

[11] Patent Number: 5,410,970

[45] Date of Patent: May 2, 1995

[54] RAILCAR ADAPTED FOR HAULING TREE LENGTH TIMBER AND LONG LOGS

[76] Inventor: Everett H. Stephenson, Jr., 243 Suncrest Blvd., Savannah, Ga. 31410

[21] Appl. No.: 197,728

[22] Filed: Feb. 17, 1994

Related U.S. Application Data

[60] Division of Ser. No. 902,097, Jun. 22, 1992, Pat. No. 5,323,711, which is a continuation-in-part of Ser. No. 710,615, Jun. 5, 1991, abandoned, which is a continuation-in-part of Ser. No. 665,495, Mar. 6, 1991, abandoned.

[51] Int. Cl.[6] ..... B60D 1/00

[52] U.S. Cl. ..... 105/355; 105/380

[58] Field of Search ..... 105/355, 380, 389, 390, 105/404; 410/37, 36, 42, 32

[56] References Cited

U.S. PATENT DOCUMENTS

| | | | |
|---|---|---|---|
| 930,623 | 8/1909 | Shillin | 105/380 |
| 2,788,750 | 4/1957 | Priest | 105/416 |
| 3,021,970 | 2/1962 | Bigge et al. | 410/37 |
| 3,464,368 | 9/1969 | Cordani | 105/369 |
| 4,003,585 | 1/1977 | Richards | 410/37 |
| 4,127,071 | 11/1978 | Thomaswick | 105/367 |
| 4,193,730 | 3/1980 | Nordin | 414/537 |
| 4,624,188 | 11/1986 | Kaleta | 105/355 |
| 4,668,000 | 5/1987 | Jokela | 296/15 |

FOREIGN PATENT DOCUMENTS

| | | | |
|---|---|---|---|
| 3911138 | 11/1990 | Germany . | |
| 676483 | 7/1979 | U.S.S.R. . | |
| 1288111 | 2/1987 | U.S.S.R. | 410/37 |

OTHER PUBLICATIONS

"New 3-In-One Car Developed by Pullman," *Pulpwood Production & Timber Harvesting,* p. 12. (no date).

"Prototype Long wood cars being tested," *CSX Transportation,* 3:May/Jun. 1989.

Blueprint and Photograph for Ortner Freight Car Co. "100 Ton Log Car," dated prior to Nov. 1986.

Stephenson, Everett, "Future Developments in Transportation Systems," Woodlands Research, Union Camp Corporation. (no date).

"Appalachian Pulp Mill Converts to Major Rail Wood Transportation System," *American Pulpwood Association Inc.,* (no date).

Specification and Photographs of car from Evans/Railcar Division, dated prior to Nov. 1986.

Car and Locomotive Cyclopedia of American Practices, Simmons-Boardman Publishing Corporation, pp. S3-161 to S3-168, 1974.

*Primary Examiner*—Mark T. Le

*Attorney, Agent, or Firm*—Woodcock, Washburn, Kurtz, Mackiewicz & Norris

[57] ABSTRACT

Railcars for transporting timber in either the "tree-length" form or "long log" form are provided. The present invention discloses a railroad car comprising a central support member having at least one set of wheels disposed near its ends. A bulkhead is affixed to each end of the central support member and a plurality of cross members extend from the central support member, to which a plurality of stanchions are affixed. Thus, the cross members and the stanchions preferably form substantially "U"-shaped structures that are in a spaced-apart relationship selected to restrain both tree-length logs and long logs. The railroad car of the present invention may also include one or more apparatus for restraining a stack of timber, such as a winch and a strap. Most preferably, at least six pairs of stanchions are provided. The distance between a first stanchion and the bulkhead is between about 7.5 and 8.5 feet; the distance between the first stanchions and a second stanchion is between about 12.0 and 13.0 feet; and the spacing between further stanchions repeats the same alternating spacing. The cross members preferably raise the logs above the deck or structure of the railcar to facilitate loading and unloading using conventional equipment.

2 Claims, 2 Drawing Sheets

RAILCAR ADAPTED FOR HAULING TREE LENGTH TIMBER AND LONG LOGS

This is a division of application Ser. No. 07/902,097, filed Jun. 22, 1992, now U.S. Pat. No. 5,323,711, which is a continuation-in-part of Ser. No. 07/710,615, filed Jun. 5, 1991, now abandoned, which in turn is a continuation-in-part of application Ser. No. 07/665,495, filed Mar. 6, 1991, now abandoned.

The present invention relates to railroad cars and, more specifically relates to railcars adapted to haul timber in the form of either tree-length logs or long logs.

BACKGROUND OF THE INVENTION

Paper mills and lumber mills are typically located in central locations with respect to the availability of resources, such as water, power, and forest resources, and access to major transportation routes for both receiving raw materials and for shipment of finished products. The demand for wood often requires the geographic area from which a particular mill draws its requirements to be quite large. Hauling distances from mills in excess of 100 to 200 miles are not unusual. Such substantial hauling distances increase transportation costs, to the point that they become a substantial factor in the overall cost of the raw materials.

The transportation method most widely used in the forest products industry for relatively short distances is truck transportation. Truck transportation is suitable for hauling logs from the harvest site to the mills ever distances of less than about 100 miles. As the distance increases beyond 100 miles, the cost of truck transportation becomes prohibitive. Truck transportation is also dependent on a good highway transportation system and can be severely restricted in certain areas due to traffic from urban and suburban development.

Beyond the practical and economical range of truck transportation, timber is generally transferred to rail for shipment. Rail transportation is economical for essentially all distances, but is particularly advantageous from a cost standpoint for long-haul areas, i.e., areas in excess of 100 miles from the mill site. Over such distances, rail is three to four times as efficient as truck transportation. Where rail transportation is employed, timber is transported short distances to a railhead and shipped to a mill for use. Rail transportation would be more widely used, except for certain shortcomings that have been encountered with respect to the railcars that have been employed to transport logs to the mill.

For various reasons, it is sometimes desirable to ship logs in a form known as "tree-length" timber which, as the name implies, are logs which are substantially the length of the tree from which they have been cut and de-branched. Typically, tree-length timber is from about 30 feet to about 50 feet in overall length. Because the longest tree-length timber is longer than about one-half the length of typical existing railcars, and since most mills cannot accept tree-length wood that is randomly oriented, it is the usual practice to load and unload this timber in two or more "decks" each deck being substantially wedge-shaped because the logs taper, that is, the diameter of the log at what was the base of the tree is larger than the other end. As a result, the load typically comprises two wedge-shaped decks with the tip ends overlapping one another. Another preferred form in which timber is shipped is in the form of "long logs" about 15–20 feet in length. Because of their shorter length, long logs may be readily placed in two or more spaced-apart stacks on the bed of the railcar. The shorter length of long logs also reduces the degree of taper encountered, and they are generally oriented randomly, resulting in stacks which are substantially "square". Because long logs are 15 to 20 feet in length, they cannot be stacked crossways on a railcar, since the maximum width of the railcar is between 10 feet, 6 inches and 10 feet, 8 inches.

Tree-length logs are the most preferred method of receiving wood at the mills, as they provide for the maximum utilization of the wood at the lowest cost. When tree-length logs are received by a mill, particularly one which is associated with a lumber operation, the economic yield from the wood is greater than with either wood chips, short wood or long logs. The tree-length logs can be sorted at the mill into logs suitable for conversion into lumber or plywood, and the less suitable logs can then be used in papermaking processes. Furthermore, the processing of tree-length logs at paper mills which have appropriate equipment, such as slasher decks to cut the logs into pre determined lengths, is considerably less expensive than cutting tree-length logs into shorter lengths or chips at the harvesting site because of the more efficient equipment and better material handling methods available at the mill site.

Thus, for example, in pulping operations employed in the making of paper and other products, it is preferable to use tree-length logs to minimize the expense related to the cutting and handling of the timber. Although the shorter long logs are frequently used, they are less well suited to pulping operations. In the pulp industry, it is thus currently the practice to utilize tractor trailers to haul both tree-length timber and long logs to pulping mills. However, the impracticality of bringing a fleet of trucks to remote logging areas, as well as the delays encountered due to highway conditions and traffic, result in a nearly unmanageable situation. Accordingly, there exists a need to provide a convenient and efficient way to ship both tree-length timber as well as long logs via rail.

Numerous railcars have been specifically designed to meet the needs of the timber industry such as railcars specifically adapted to carry tree-length timber. However, because of the simpler loading configuration, the bulk of the railcars designed for hauling logs used in North America are adapted to carry long logs. As shown in the Car and Locomotive Cyclopedia, compiled and edited for the Association of American Railroads (Simmons-Boardman Pub. 1974), numerous designs for log hauling are shown in the section designated "Flat Cars" at pp. S3-161–S-168. Particularly at page S3-162, a log car built for Burlington Northern is shown. The Burlington Northern Log Car has a center sill, outer sills and an open floor, together with side supports for the logs. Numerous other flat car designs having flat floors and bulkheads disposed at either longitudinal end are also shown in the same reference.

U.S. Pat. No. 934,906 (Frame et al.) discloses a railcar adapted for transporting logs having a longitudinally extending central member or "sill" extending the length of the railcar and a pair of bolsters oriented transversely and attached to the sill near either end of the sill. U.S. Pat. No. 711,271 (Ashcraft et al.) also discloses a railcar adapted to carry logs. The railcars disclosed by Frame et al. and Ashcraft et al., however, are essentially "skeleton" flat cars, wherein the logs are stacked lengthwise and retained by a chain extending over the stack. Others have found that when hauling logs, it will be desirable to provide vertical standards or stanchions, attached to the distal ends of the transverse bolsters, such as the log carrier disclosed in U.S. Pat. No. 405,819 (Billings) and the railcar disclosed in U.S. Pat. No. 1,799,628 (Enowles).

U.S. Pat. No. 930,623 (Shillin) discloses the use of stakes attached to logging cars to retain logs in position during transportation. Also disclosed are means for locking the stakes in position during transit and means for releasing the locking means to permit repositioning of the stakes, thereby allowing discharges of the logs from either side of the car.

U.S. Pat. No. 4,624,188 (Kaleta) discloses bulkheads with fixed side and end container restraining walls with moveable corner engaging mechanisms to selectively restrain either a short or a long container supported upon a lower container in transport position.

The problems which have been encountered using such prior art designs are to a large extent a result of the inherent tapered shape of tree-length logs. The butt end of the logs, that is, the end that was at the root of the tree, is always larger than the tip end of the log. Furthermore, the individual logs may be somewhat twisted, which is not conducive to uniform stacking. The problem of instability of the stacks of logs on the railcars is further complicated by the requirements of the mills that the stacks of tree-length logs be aligned with all the butt ends at one end of a given stack so as to facilitate the unloading and handling of the logs at the mills. It is this practice that leads to loading the railcars with wedge-shaped "decks" of tree-length logs. It has been found, however, that such decks are inherently unstable in transit. The logs in the decks readily break loose or are repositioned so as to cause potential serious problems and personal injury. In transit, railcars are regularly subjected to impact as a result of starting and stopping that can have a force of several miles an hour. Impact at speeds as low as 5 miles per hour can cause a deck of logs to shift in position. Furthermore, when the railcars are struck, the wedge configuration often causes one or more of the individual tree-length logs within the wedge to slide forward out of the deck. As the individual logs start to slide forward, the entire deck becomes unstable. The individual logs are often ultimately forced from the decks, where they can either fall onto the tracks, causing serious safety problems, or project from the side of the railcars to contact and damage trains, cargo, and injure personnel on adjacent trains and tracks.

Other problems similar to those described above have been encountered when hauling tree-length logs. One such problem is that when the logs are transported in decks they tend to become entangled with each other. When the logs arrive at the mill it then becomes very difficult, if not impossible, to unload them in bulk from the railcars, thus substantially increasing the amount of time required for unloading and handling of the logs. A related problem is that the railcars utilized for hauling of tree-length logs must be exceptionally durable and rugged, but-also should be as light in weight as possible. In use, railcars used for hauling tree-length logs must be able to endure the day-in, day-out abuse encountered in both the loading and unloading of the logs. While the durability of the cars can be increased by using heavier weight members and increasing the reinforcement, as is conventional with other types of cars, increased weight presents problems, in that there is a maximum weight allowable for railcars and their loads that can be transported on existing rails. Tree length logs are an exceptionally heavy cargo and, accordingly, increasing the strength by using heavier weight members and additional reinforcement directly reduces the effective payload of the logs which can be handled.

It would therefore be highly advantageous to provide a railcar suitable for safe handling of tree-length logs which can easily be loaded and off-loaded, and which is strong enough to endure the rough handling encountered in normal use. Additionally, it would be desirable to design such a railcar that could also readily transport long logs.

SUMMARY OF THE INVENTION

The present invention discloses a railroad car for transporting timber that comprises a central support member having a first end and a second end and at least one set of wheels disposed near each of the first and second ends of the central support member. Bulkheads are preferably affixed to each end of the central support member. A plurality of cross members, each having a first end and a second end, are fixedly attached to the central support member and extend laterally therefrom. One of a plurality of upright stanchions, each having a distal end and a proximal end, is affixed at its proximal end to each of the first and second end of each cross member and extends substantially vertically therefrom. The cross members and stanchions thus form a plurality of U-shaped structures that are affixed to the central support member in a spaced-apart relationship to restrain timber in the form of either tree-length logs or long logs. Most preferably, six U-shaped structures are provided and are spaced in a particularly preferred arrangement to permit both forms of timber to be hauled while maximizing the stability of the load and the accessibility for material handling equipment.

Thus, in a most preferred embodiment, a first U shaped structure is spaced between about 7.5 and 8.5 feet from a first bulkhead; the first U-shaped structure being spaced between about 12.0 and 13.0 feet from a second U-shaped structure; and further U-shaped structure are spaced in the same alternating spacing, whereby one of the further U-shaped structures is spaced between about 7.5 and 8.5 feet from a second bulkhead.

In certain embodiments, additional longitudinal supports, and a bed disposed between the cross members and the central support members are incorporated into the structure of the railcar. Additionally, it is .also desirable in certain embodiments to provide at least one means for restraining a deck of timber, such as a winch in conjunction with a belt, strap or chain. Also, the bulkheads used in certain preferred embodiments are wrap around bulkheads that comprise means for restraining the butt ends of the logs from motion in both a longitudinal and a lateral direction.

DETAILED DESCRIPTION OF THE PREFERRED EMBODIMENTS

Figure 1:
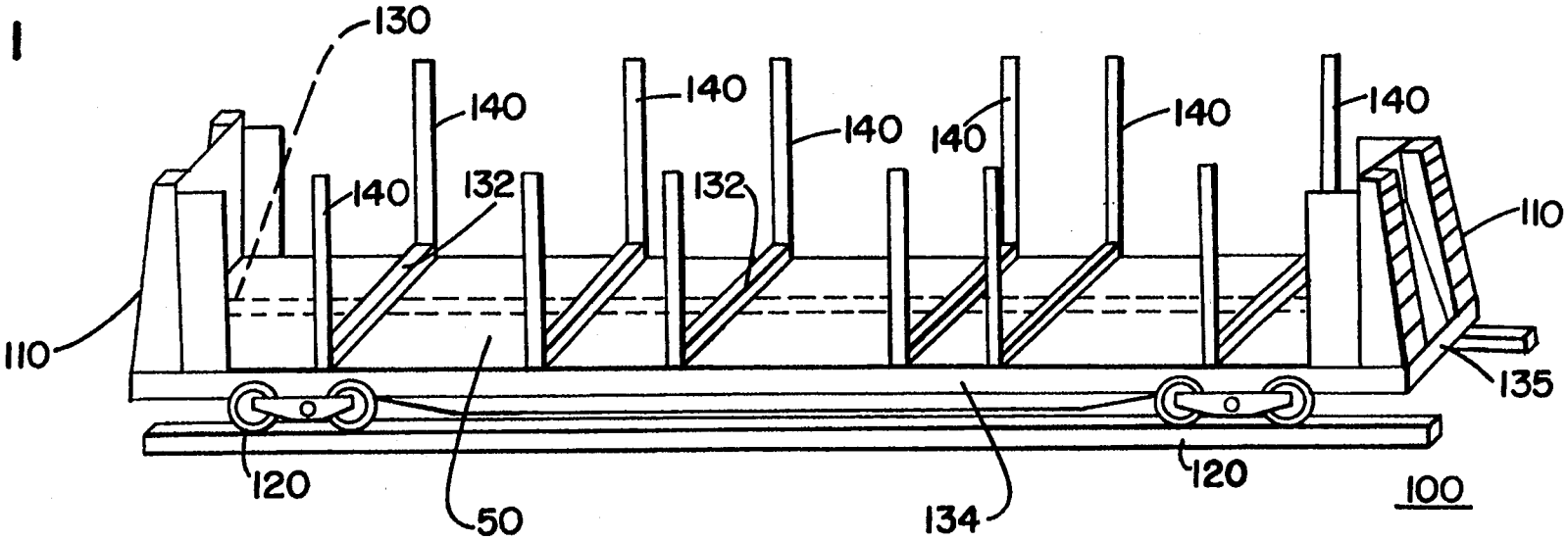
FIG. 1 illustrates a perspective view of a railcar made in accordance with the present invention.

A railcar made in accordance with the present invention 100 is shown in FIG. 1. The railcar 100 has trucks 120 of conventional design, known to those skilled in the art, located at each end of the railcar 100. Positioned .on the trucks 120 is a bed 50 on top of a support structure, not fully shown in this view, comprised of a center sill 130, side sills 134, and end sills 135. The bed 50 is secured to the elements of the support structure. The size of the center sill 130 and the side sills 134, as well as the bed 50, depend upon the load requirements for the railcar 100.

Positioned along the top surface of the bed 50 are a plurality of U-shaped structures comprised of upright stanchions 140 and cross members 132. The stanchions 140 and the cross members 132 are securely fastened together, as, for example, by bolting, and more preferably by welding. The U-shaped structures are located at predetermined positions along the length of the bed 50, with the cross members 132 creating a series of elevated points above the bed 50 to enhance loading and unloading, as explained in greater detail below. The U-shaped structures, and in particular the cross members 132, are most preferably aligned with and secured to structural elements of the railcar 100 at the side sill members 134 to form a unified, rigid structure. At each end of a preferred embodiment of the railcar 100 are wrap-around bulkheads 110. These bulkheads 110 extend across the width of the railcar 100 and a wrap-around portion of the bulkhead 110 extends from the ends of the railcar 100 toward the center of the railcar 100 for a distance that is most preferably greater than the distance the tree-length logs are anticipated to shift during transit. A length of three feet or more has been found in practice to exceed what is encountered with regard to the above-described shifting of the logs in use with the present invention.

Figure 2:
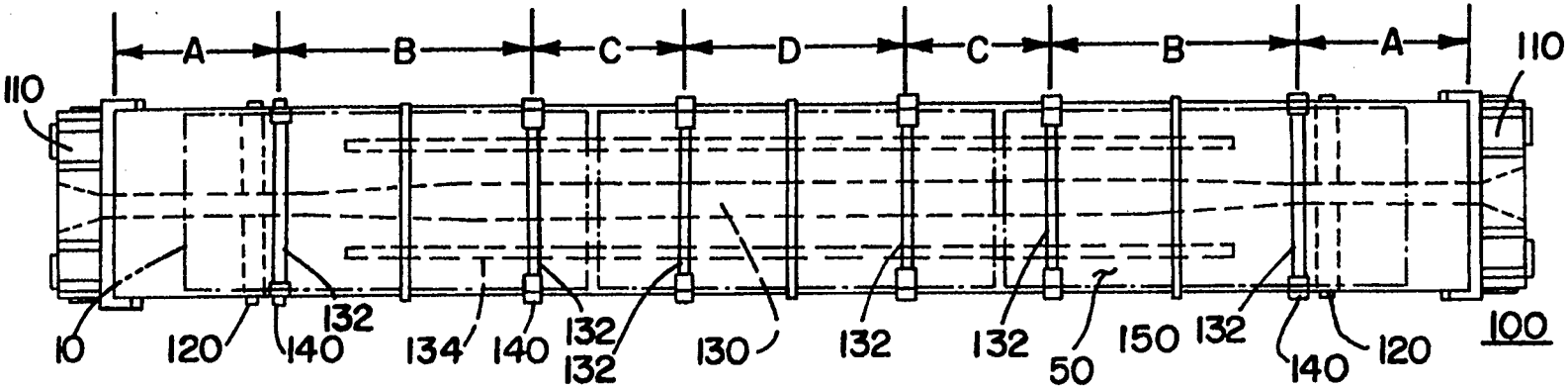
FIG. 2 is a top plan view of a railcar made in accordance with the present invention.

Further details of the railcar 100 of the present invention are shown in FIG. 2. As seen in phantom, the longitudinal support member or center sill 130 preferably extends the entire length of the railcar 100, providing a rigid structure to which the remaining elements may be attached. Extending transversely from the center sill are a plurality of cross-members 132. As best seen by comparing FIG. I and FIG. 2, in a preferred embodiment of the present invention, the stanchions 140 are affixed to the ends of the cross-members 132. Thus, the load is supported in an essentially "U"-shaped structure, comprised of a cross-member 132 and two upwardly extending stanchions 140 affixed thereto. Each "U"-shaped structure is in turn rigidly attached to the center sill 130 at the cross-member 132, thereby forming a railcar body section adapted to retain long logs or timber length logs. As explained above, however, in certain preferred embodiments, a deck 50 is disposed beneath the cross-member 132.

Figure 3:
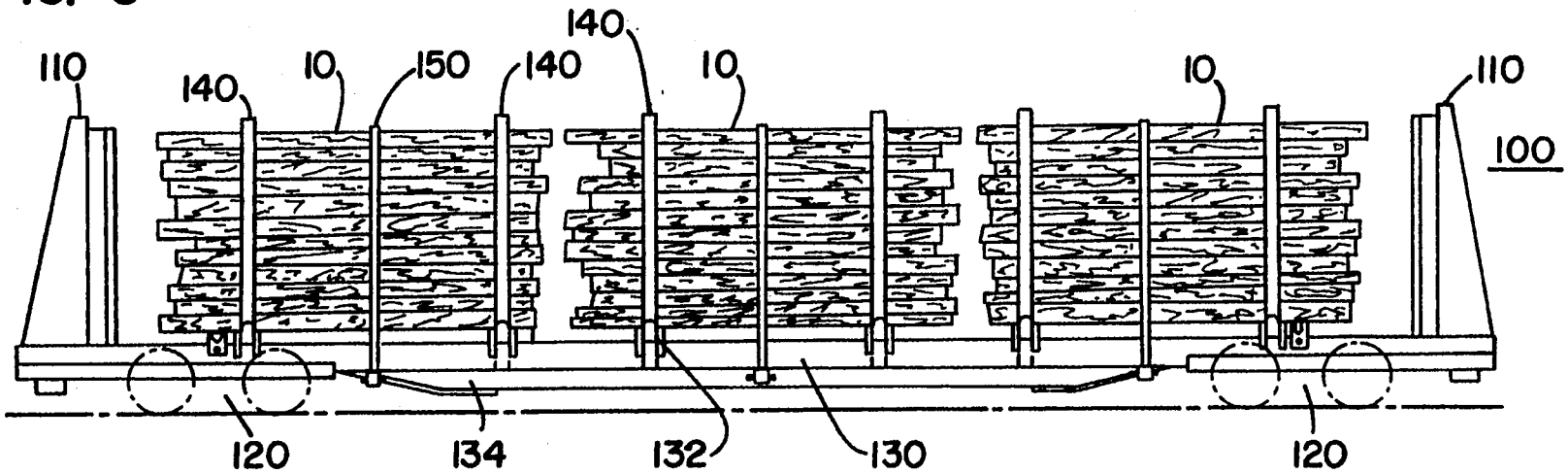
FIG. 3 is a side elevation view of a railcar shown in FIG. 2, loaded with long logs.

Referring now to FIG. 3, a side elevation of a railcar 100 made in accordance with the present invention loaded with three stacks of long logs 10 is shown. Also visible in this view is the longitudinal central support member 130 that is shown in phantom in FIGS. 1 and 2. In addition, side sills 134 that may be incorporated because of inherent light weight, rigidity and adaptability to the railcars disclosed herein, are also seen. As described above, the stacks of long logs 10 are prevented from moving laterally by a plurality of upwardly extending stanchions 140. The stanchions 140 are constructed, for example, of rectangular tube having dimensions of about six inches by eight inches. As known to those of ordinary skill, one side of a bolster is often constructed to have one or more protruding edges which "bite" into the timber being carried in order to further secure the load and this feature may be incorporated into the present invention. As seen in FIG. 3, in a preferred embodiment, the cross members 132 are placed atop the central support member 130, thereby creating a clearance between the load and the railcar structure to facilitate loading and unloading. Finally, the logs 10 are firmly held in place by a restraining means 150 passing over and around each stack at approximately its longitudinal center.

Figure 4:
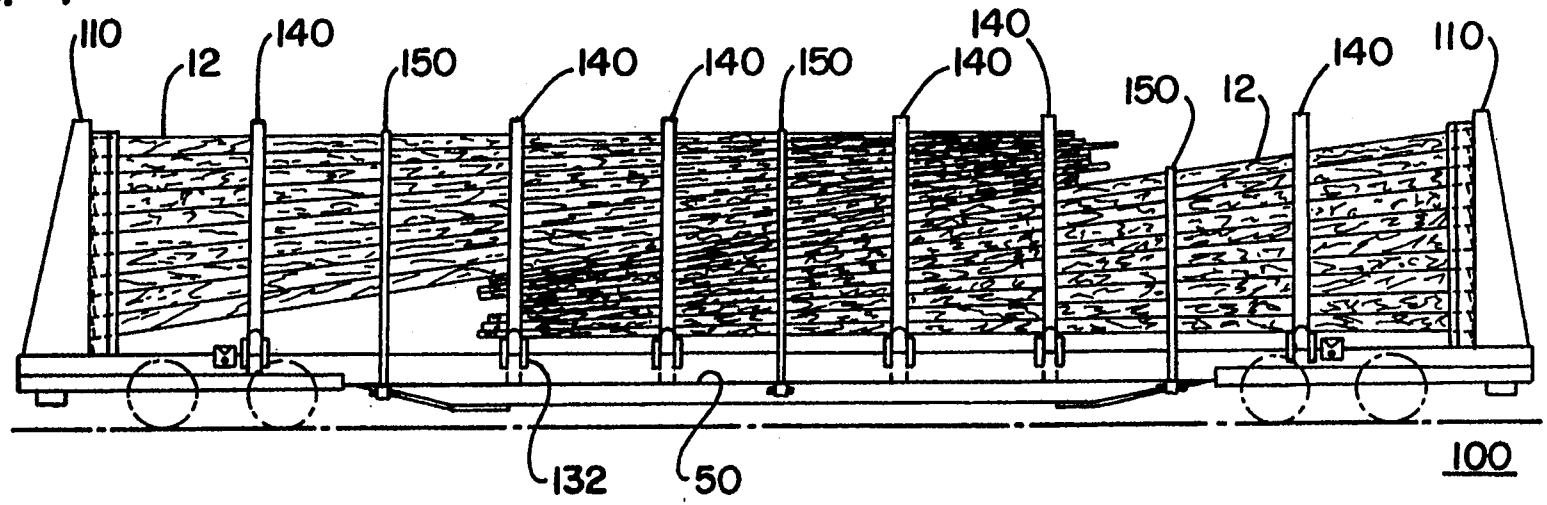
FIG. 4 is a side elevation view of a railcar shown in FIG. 2, loaded with tree-length logs.

Referring now to FIG. 4, the railcar 100 shown and described with reference to FIGS. 1–3 is illustrated with two "decks" of tree-length timber 12 loaded thereon. As described above, due to the taper typically encountered in timber of this length, when the logs are stacked they form tapered decks 12, as shown. The spacing of the U-shaped structures in the present invention again permits a load of this type of load to be easily and securely transported by rail. The cross member 132, which is part of the U-shaped structure, is of a sufficient height to support and hold the logs off the bed 50 a sufficient distance to allow a gripper clamp or other unloading device to pass around the entire deck of logs 12. By providing a clearance under the top tier at its balance point as shown, the two decks 12 may be unloaded using conventional overhead cranes or mobile log stackers. At least five pairs of stanchions 140 restrain each deck 12; the placement of the three restraining means 150 described above permits one strap 150 to restrain an end of a deck 12, while the third central strap 150 is passed over both decks 12. When loaded with tree-length timber, the bulkheads 110 abut the ends of the decks 12 and may be constructed to form a channel which retains the ends or "butts" of the logs. Thus, when loaded in the manner depicted in FIG. 4, the railcar 100 of the present invention secures two decks of tree-length logs 12 from motion in any direction by the combined effect of the stanchions 140, restraining means 150 and bulkheads 110.

Referring again to FIG. 2, the spacing of the cross members 132 and the stanchions 140 affixed thereto is shown by the letters A–D. The spacing of the structural members of the railcar 100 disclosed by the present invention entails the consideration of many design factors. For example, the U-shaped structures must be spaced to provide a structure that is sufficiently stable and rigid to support the desired load. However, practical considerations also govern the spacing of these members, for example, certain constraints are dictated by the size and shape of the U-shaped structures and the manner in which they are connected to the rest of the railcar. In providing a solution to the need for a railcar capable of safely and securely transporting both long logs and tree-length timber, the geometry of the loads and the manner in which they are loaded and unloaded is also a significant consideration.

In principle, it would be desirable to have stanchions 140 and cross members 132 evenly spaced along the load to secure the load and to facilitate production and standardize certain components. However, given the geometric constraints of the different loads and of the material handling equipment, even spacing does not present a practical solution. It has been found however, that by spacing six U-shaped members comprised of cross members 132 and stanchions 140 in a pattern substantially as shown in FIG. 2, the capability to safely carry both long logs and tree-length timber discussed above is achieved. In a preferred embodiment of the railcar of the present invention the distance between the bulkheads 110 is about seventy feet. Preferably, the distance A from the inside of the bulkhead 110 to the first U-shaped member is between about 7.5 and 8.5 feet; the distance B to the next U-shaped member is between about 12.0 and 13.0 feet; the distance to the next U-shaped member is about the same as A, between about 7.5 and 8.5 feet; and the distance D across the center of the car to the next U-shaped member is about the same as B, i.e., between about 12.0 and 13.0 feet. The above-described spacings are then repeated in the reverse order, i.e., C-B-A, on the other side of the railcar center. As shown, three sets of restraining means 150 are preferably provided and centered within the "B" and "D" sections. In a most preferred embodiment of the railcars of the present invention, the above-described spacing ranges have been more carefully optimized to provide the most effective possible spacing. The A dimension between the end of the railcar and the first U-shaped member is most preferably about 8.5 feet; the distance to the next U-shaped member, B, is about 13.0 feet; the C dimension to the next U-shaped member is about 7.5 feet and the central section, D, is about 12.0 feet. The C-B-A spacings are again symmetrically located and are accordingly about 7.5, 13.0, and 8.5 feet respectively.

Using the spacings set forth above, it is now possible to conveniently load and securely transport either long logs or tree-length timber on the same railcar. Referring again to FIG. 3, it can be seen that three stacks of timber 10 which have been cut to long log length may be positioned between the stanchions 140. By positioning the center portion of each stack in either the above-described "B" or "D" sections, it is possible to place the stacks 10 in a spaced-apart manner which permits their loading and removal by conventional equipment. The bulkheads 110 prevent the stacks from undue amounts of shifting in the case where the car accelerates or decelerates. As explained with reference to FIG. 4, the preferred spacings also permit two decks 12 of tree-length timber to be hauled while restrained by the same arrangement of U-shaped structures, bulkheads 110, and restraining means 150. It has been found in testing that the railcar of this invention 100 can be used to satisfactorily haul tree-length logs for indefinite distances without shifting the load, and can be unloaded at the mill site in a matter of minutes.

Although certain embodiments of the present invention have been set forth above in detail, these embodiments are meant to be illustrative and do not limit the present invention. Numerous variations, adaptations and alterations may be made within the spirit of the invention described herein by those of ordinary skill. In particular, the present invention is not meant to be limited to any particular structural configurations of the bed of the railcar 100 or the wheel sets 120 attached thereto. It is also understood that a floor may be provided to overlie one or more sections of the railcar bed or the bed may be of an open "skeleton" configuration. Similarly, the materials and structural shapes used for the stanchions and other components is not meant to be limited by those described or depicted in the accompanying figures. Accordingly, reference should be made to the appended claims to determine the scope of the present invention.

What is claimed is:

1. A method of transporting timber in either tree length form or long log form by railway by using the same railroad car, comprising:

(a) loading two decks of tree length logs onto a bed of a railway car so that respective balance points of the two decks of tree length logs are each substantially centered between two adjacent stanchion pairs of the railway car;

(b) transporting the tree length logs to a destination by railway;

(c) unloading the tree length logs from the railcar;

(d) loading three stacks of long logs onto the bed of the railroad car so that the respective center portion of each stack of long logs is substantially centered between two adjacent stanchion pairs of the railway car; and (e) transporting the long logs to a destination by railway, whereby the cost and logistical problems created by having different railway cars for long logs and tree length logs are eliminated.

2. A method of transporting timber in either tree length form or long log form by railway by using the same railroad car, comprising:

(a) loading three stacks of long logs onto the bed of a railroad car so that respective center portions of each stack of long logs is substantially centered between two adjacent stanchion pairs of the railway car;

(b) transporting the long logs to a destination by railway;

(c) loading two decks of tree length logs onto the bed of the railway car so that respective balance points of the two decks of tree length logs are each substantially centered between two adjacent stanchion pairs of the railway car;

(d) transporting the tree length logs to a destination by railway; and (e) unloading the tree length logs from the railcar, whereby the cost and logistical problems created by having different railway cars-for long logs and tree length logs are eliminated.

* * * * *

UNITED STATES PATENT AND TRADEMARK OFFICE

CERTIFICATE OF CORRECTION

PATENT NO. : 5,410,970

DATED : May 2, 1995

INVENTOR(S) : Everett H. Stephenson, Jr.

It is certified that error appears in the above-indentified patent and that said Letters Patent is hereby corrected as shown below:

On title page, add item [73] --Assignee: Union Camp Corporation, Wayne, New Jersey--

Signed and Sealed this

Second Day of January, 1996

Bruce Lehman

*Attest:*

BRUCE LEHMAN

*Attesting Officer*

*Commissioner of Patents and Trademarks*